US007205962B2

(12) United States Patent
Cooke

(10) Patent No.: US 7,205,962 B2
(45) Date of Patent: Apr. 17, 2007

(54) SCREEN DISPLAY DEVICE

(76) Inventor: Richard Cooke, Unit 3, 315 Flemington Road, North Melbourne, VIC 3051 (AU)

( * ) Notice: Subject to any disclaimer, the term of this patent is extended or adjusted under 35 U.S.C. 154(b) by 930 days.

(21) Appl. No.: 10/240,813

(22) PCT Filed: Apr. 4, 2001

(86) PCT No.: PCT/AU01/00373

§ 371 (c)(1),
(2), (4) Date: Oct. 4, 2002

(87) PCT Pub. No.: WO01/75845

PCT Pub. Date: Oct. 11, 2001

(65) Prior Publication Data

US 2003/0063063 A1 Apr. 3, 2003

(30) Foreign Application Priority Data

Apr. 4, 2000 (AU) ..... PQ6690

(51) Int. Cl.
*G09G 3/28* (2006.01)

(52) U.S. Cl. ..... 345/60; 345/204; 345/205; 345/206; 346/140.1; 101/483

(58) Field of Classification Search ..... 345/60, 345/204, 205, 206; 346/140.1; 101/483
See application file for complete search history.

(56) References Cited

U.S. PATENT DOCUMENTS 5,771,810 A * 6/1998 Wolcott ..... 101/483
6,037,955 A * 3/2000 DeBoer et al. ..... 346/140.1
6,179,584 B1 * 1/2001 Howitz et al. ..... 417/413.2

OTHER PUBLICATIONS

International Search Report prepared by ISA/AU in connection with PCT/AU01/00373 and completed on Apr. 17, 2001.

Derwent Abstract Accession No. G3211 K/19, Class P85, NL 8104279A, ERG EVENTSTRUCT RES, Apr. 18, 1983.

Derwent Abstract Accession No. 98-490759/42, Class W05, JP 10213756A, FUJITSU LTD, Aug. 11, 1998.

Derwent Abstract Accession No. 89-039917/06, Class P85, DE 3723536A, Neumann H, Feb. 9, 1989.

* cited by examiner

*Primary Examiner*—Richard Hjerpe
*Assistant Examiner*—Leonid Shapiro
(74) *Attorney, Agent, or Firm*—Fellers Snider, et al.

(57) ABSTRACT

A screen display device (1) with a plurality of display elements (2), the display elements (2) comprising: (a) at least one display chamber (5) for containing display fluid; (b) at least storage chamber (6) in fluid communication with the display chamber (5); (c) the fluid being movable between the display chamber (5) and the storage chamber (6); (d) control means (7) for controlling fluid movement between the display chamber (5) and the storage chamber (6); and (d) a display screen (3); wherein each display chamber (5) is arranged to provide an image of fluid in the display chamber (5) through the display screen (3). An electronic device having a screen display device (1) according to the invention is also disclosed.

36 Claims, 2 Drawing Sheets

SCREEN DISPLAY DEVICE

FIELD OF THE INVENTION

The present invention relates to a screen display device. In a particular non-limiting application it relates to monitors or screens used in electronic display devices with screen saving capability. More particularly the invention relates to a screen display device for portable electronic devices, such as laptop and mobile phones.

BACKGROUND OF THE INVENTION

Whilst the following discussion concerns screen saving devices for laptop display and screens, it is to be understood that the same principles apply to any displays using pixels or other display elements, especially electronic displays using display elements to form an image on a display screen. Such displays may be components of computers, mobile phones, electronic score boards or electronic billboards.

In this specification, where a document, act or item of knowledge is referred to or discussed, this reference or discussion is not an admission that the document, act or item of knowledge or any combination thereof was at the priority date:

part of the common general knowledge, or known to be relevant to an attempt to solve any problem with which this specification is concerned.

So-called screen saving devices for monitors or screens used in electronic display devices are in common use. Such screen saving devices are commonly used for monitors connected to computers and portable computers, such as laptop. One of the purposes of screen saving devices is to conserve energy expended in maintaining a constant image on the screen or monitor.

In portable computers, such as laptop, an array of pixels (often made of liquid crystals) is arranged behind the display screen. An electric pulse is sent to the array to activate or deactivate the pixels to form the image and a backlight shines light through the pixels, producing an image on a display screen. The electric pulse trust be sent quite frequently to the array in order to maintain the image on the display screen. This is known as "refreshing" the image. Most standard laptop need to refresh the image up to 75 times per second. This refreshing process uses a substantial amount of the battery power of the laptop, thereby reducing usage time. In addition, the whole image has to be refreshed even though only a small portion of the whole image on the display screen may need to change, such as, for example, the movement of a cursor or mouse arrow.

Conventional screen saving devices tend to resort to switching off the backlight after a certain time period passes in which the laptop screen is inactive. However, theses conventional screen saving devices do not operate when the laptop is in use. Consequently, they do not deal with conserving battery power expended by refreshing the image on the display screen.

SUMMARY OF THE INVENTION

According to one form of the invention there is provided a screen display device with a plurality of display elements, the display elements comprising:

(a) at least one display chamber for containing display fluid;

(b) at least one storage chamber in fluid communication with the display chamber;

(c) the fluid capable of being moved between the display chamber and the storage chamber;

(d) control means for controlling the movement of fluid between the display chamber and the storage chamber; and (e) a display screen;

wherein each display chamber is arranged to provide an image of fluid in the display chamber through the display screen.

Movement of the fluid between the display chamber and the storage chamber may be provided by movement means.

The control means may act upon the display fluid in order to reduce or remove the necessity to re-energize or re-activate the means for moving the fluid between the display chamber and the storage chamber in order to refresh the image and therein maintain a substantially constant volume of fluid within a chamber.

The present invention provides in another embodiment an electronic device having a screen display device as described herein. The electronic device may be non-exhaustively a monitor, a computer, a laptop computer, a hand held computer, an electronic organiser, a telephone, a mobile telephone or a television monitor. The display chamber may be located abutting the display screen. Alternatively, the display screen may form a wall of the display chamber. It is even possible that a wall of the display chamber may be slightly removed from the display screen. Such an arrangement may be preferred where the actuator means is arranged between the display screen and the display chamber. The wall of the display chamber through which the fluid may be viewed should be transparent or at least translucent. Lighting means may be provided to light the image on the display screen produced by fluid in the display chamber. Light produced by the lighting means may impinge forwardly or rearwardly of the display chamber. The lighting means may be similar to back lighting used with current liquid crystal displays often used for laptop computers.

In instances where inverse video imaging is required an outer wall of the storage chamber may be translucent or transparent to allow for an inverse image of the image displayed on the display screen.

The display chamber may be formed from thermoplastic material. It may be integrally formed from thermoplastic material with the storage chamber.

Suitably, means are provided to prevent fluid held in the storage chamber from forming an image on the display screen. For this purpose, the storage chamber may be formed of material which is not transparent. Alternatively it may be coated with nontransparent material or it may be shielded with non-transparent material.

The display chamber may be constructed so as to have a variable volume. In one embodiment, this variable volume feature may take the form of a flexible or elastic wall. The wall may be flexed to vary the volume in the display chamber so that fluid volume in the display chamber may be increased or decreased as required.

Where the wall is elastic, the energy in one phase can be used to store energy in the elastic wall in the form of potential energy allowing the stored energy to be used in another phase thereby reducing the need to activate the movement means and reducing the complexity of the display element.

It is envisaged that the use of passive components (which store potential energy) may further reduce energy consumption and decrease the complexity of the display element design. In this embodiment if control means need to be activated, these components may need to be energized. Similarly further energy reduction can be achieved by using one way valves or other similar biasing control means. In another embodiment the volume of the display chamber may be varied by means of a piston.

There may be a conduit between the display chamber and storage chamber. The conduit may be integrally formed with the display chamber and storage chamber. With such a construction the valve means may be located in the conduit. The storage chamber may also have a variable volume for this purpose. It may also include a flexible or elastic wall or a piston. It may also include return means for returning fluid to the display chamber. In one embodiment this may take the form of an actuator means which presses on a flexible wall of the storage chamber to reduce its volume.

Where the wall is elastic, the energy in one phase can be used to store energy in the elastic wall in the form of potential energy allowing the stored energy to be used in another phase thereby reducing the need to activate the movement means and reducing the complexity of the display element.

It is envisaged that the use of passive components (which store potential energy) may further reduce energy consumption and decrease the complexity of the display element design. In this embodiment if control means need to be activated, these components may need to be energized. Similarly further energy reduction can be achieved by using one way valves or other similar biasing control elements Suitably the movement means may be an actuator means. The actuator means may be any suitable device for varying the volume of the display chamber. For example, it may take the form of a piezoelectric crystal which expands to press against a wall of the display chamber. Alternatively it may comprise an electromagnetic transducer, pump or piston.

Suitably the control means may be a valve means. The valve means may comprise a piezoelectric valve. Alternatively it may comprise biasing means, a valve body and one or more valve seats. Examples of several forms of suitable valves include spool valves, butterfly valves or the like.

Where the actuator means is located between the display surface and the display chamber the actuator means is preferably formed from transparent material.

Each of the display elements is suitably sealed against fluid communication with all of the other display elements. A plurality of display elements may be grouped to form a pixel. In such an arrangement, the different members of the group of display elements may include different colored fluid.

Alternatively, where a monochrome display is required, each display element may represent a pixel.

Alternatively a plurality of storage chambers may be in fluid communication with a display chamber. In this embodiment each of the storage chambers may contain fluid of a different color. In this arrangement movement means is suitably arranged to allow for fluid communication between the respective chambers.

In an alternative form of the invention a membrane may be provided to define a storage chamber and a display chamber. Preferably the membrane spans opposed walls of a single chamber. The membrane may be suitably moved by actuator means from a position abutting the display screen to a position remote from the display screen wherein the movement of the membrane allows for the flow of display fluid to the display screen.

In the initial position the color of the display screen significantly mirrors the color of the membrane. Movement of the membrane allows for the display fluid to pass through the membrane allowing the color of the fluid to be visible on the display screen.

Where the display elements are in the form of pixels, they should suitably be of a size not normally visible individually when viewed by the naked eye at a distance suitable for viewing the display on the screen display device. Where the display elements form pixels they suitably provide individual image elements of generally round or square shape.

Whilst the invention is applicable for screen display devices operating in a similar fashion to television or computer screens, it is to be understood that it is also applicable for instances where macro images need to be produced. For example, where the images produced by the display elements are individually visible they may take any appropriate shape and size. For example the images may be in the form of letters, symbols or pictures presented on a large scale billboard. Thus the invention encompasses within its scope all forms of applications of screen display devices according to the invention, including computer screens, television screens, billboards, signs and indicators.

In a further aspect of the invention, there is provided a display device for a screen display device which incorporates the features of a display element as described herein. The construction of the display elements is preferably such that they may change the image which they individually produce when they are activated and upon change of the image to a new form they retain the new image when they are deactivated without acquiring refreshment.

According to one form of the invention there is provided a screen display device with a plurality of display elements, the display elements comprising:

(a) at least one display chamber for containing display components;

(b) at least one storage chamber in communication with the display chamber;

(c) the components capable of being moved between the display chamber and the storage chamber;

(d) control means for controlling the movement of fluid between the display chamber and the storage chamber; and (e) a display screen;

wherein each display chamber is arranged to provide an image of fluid in the display chamber through the display screen.

The display component may take any suitable form. Preferably the display component is a flowable material. The flowable material may be a fluid. The fluid may be a liquid. It may be a gas. A suitable liquid may be an ink. Alternatively the flowable material may be composed of a plurality of solid components. The solid components may be substantially spherical.

Preferred aspects of the invention will now be described with reference to the accompanying drawings.

DESCRIPTION OF THE DRAWINGS

The invention will now be further explained and illustrated by reference to the accompanying non-limiting drawings in which:

Referring to FIG. 1, the display screen device 1 comprises a plurality of display elements 2, each containing a liquid for displaying an image on or through display screen 3. The display screen 1 can be the screen or monitor for a computer, laptop, mobile phone or other device using a visual display screen, such as score boards or billboards. It may be backlit with electrical or other illumination. The liquid may comprise black or coloured fluid such as liquid crystal, ink or similar.

Each of the display elements 2 forms a closed system. That is, the liquid contained in each display element 2 is not transferable between other display elements 2.

Figure 2:
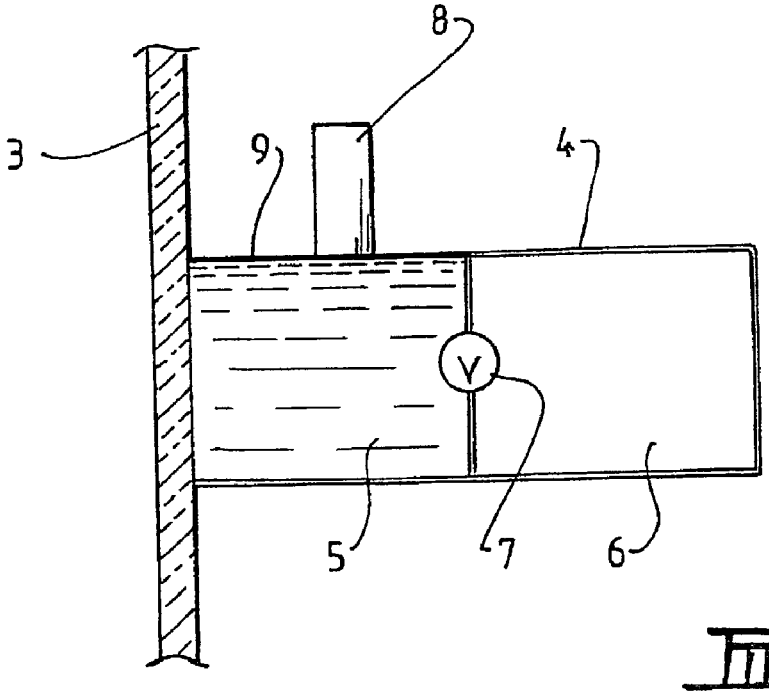
FIG. 2 is a cross-sectional view of a section of a screen display device according to one embodiment of the invention.

Referring to FIG. 2, each display element 2 comprises a display screen 3 and a fluid reservoir 4. The fluid reservoir 4 comprises display chamber 5, storage chamber 6, valve means 7 and actuator means 8. Display chamber 5 contains liquid and has at least one flexible wall 9. Display chamber 5 is in fluid communication with storage chamber 6 via valve means 7. Valve means 7 is ordinarily in a closed position. An actuator 8 is located abutting the flexible wall 9. The actuator may be any device which may compress or reduce the volume of the display chamber 5 such as a piezoelectric device, electromagnetic actuator or a mechanically operated lever or piston.

For an image to be projected onto display screen 3, an amount of liquid must be held in the respective display chamber 5. A signal is sent to each display element 2. Display element 2 then activates actuator means 8 to exert pressure on flexible wall 9 of display chamber 5. This pressure is transmitted to the liquid inside the display chamber 5. Valve means 7 moves into an open position so that liquid flows into storage chamber 6. Once the correct amount of liquid has been moved from display chamber 5 to storage chamber 6, actuator means 8 is deactivated and valve means 7 moves into its closed position. This substantially inhibits further fluid from returning to display chamber 5. Typically, for a digital type display substantially all of the fluid will be held in the display chamber or storage chamber. This corresponds to the presence or absence of a pixel image on the display screen.

However in alternative forms of the invention the display chamber may be caused to act more in the form of an analogue rather than a digital display. For example, only a proportion of the fluid in the display chamber may be moved to the storage chamber, thereby forming a partial rather than a full image of the display element on the display screen.

Furthermore, the shape of the display chamber, and the image it produces as a image element, may be any shape suitable for giving a display formed of a plurality of image elements. Where the image on the display screen is made up of a large number of pixels and each display chamber represents a pixel or a component of a pixel, the image and hence shape of the display chamber will typically be round or square. However, in applications where the image elements are relatively large (ie. they are individually visible) they may take complex shapes. Examples of such shapes include letters of the alphabet or other symbols.

The required amount of liquid is contained in the display chamber 5 for the purposes of creating an image element for display screen 3.

The valve means 7 is one which is normally closed when there is no electrical signal applied to the display element. Thus, there is no change made to the image element when there is no signal. It is therefore "locked" in without requiring power consumption to substantially refresh the image element at a rapid rate. If there is small amount of valve leakage, the image element may still need to be refreshed, but at a substantially less frequent rate. This is in direct contrast to display screens of laptop computers and other display screen electronic images which require frequent and rapid refreshment up to 75 times per second.

When the image element needs to be changed the amount of liquid in the display chamber 5 must either increase or decrease. In either case, the valve means 7 is in an open position. Where less or no liquid is required in display chamber 5, actuator means 8 is activated to exert pressure on wall 9 of display chamber 5 to force liquid through the open valve into storage chamber 6. The valve then closes to prevent liquid returning to storage chamber 6. Conversely, when liquid is required in display chamber 5, the valve is opened, actuator means 8 is not activated and a combination of the resilience of the flexible wall and atmospheric pressure causes liquid to move from storage chamber 6 into display chamber 5. When the required amount of fluid is in display chamber 5, valve means 7 moves into its closed position. For the display chamber and storage chamber to work in the manner described with reference to FIG. 2, the chambers need to be constructed so that their volumes are variable. Thus, the pressure of the actuator on the flexible wall 9 reduces the volume of the display chamber to force liquid out. Similarly, the storage chamber may be collapsible in response to the return of the flexible wall to its original position and the normal effects of atmospheric pressure on the storage chamber. Alternatively or additionally the storage chamber may also employ a form of activator similar to that described for the display chamber to drive liquid out of the storage chamber into the display chamber.

The screen saving display of the present invention is particularly useful for mobile electronic devices, such as laptop computers, electronic diaries or mobile phones. It is contemplated that the screen display device may also be used for other electronic display devices such as computer monitors, electronic score boards or billboards.

As each of the display elements are separate closed systems, only those display elements forming the portion of the image to be changed have to be activated. Consequently, energy is conserved by updating only the parts of the image that need to be changed. For example, if the image of a word document need only change at the point where text is being typed into that document, only display elements of that part of the image need to be activated.

The display elements can constitute one pixel in an image or may constitute individual colour elements for a single pixel. In the latter case, usually a grouping of three display elements forms or represents one pixel in an image. The three display elements separately show individual colours, either by way of coloured liquids, colour filters or both. Any suitable combination of colour may be chosen. For example, magenta, yellow and cyan may be chosen. By varying amounts of fluid in each display element, a full range of colours can be produced in a pixel and so form a coherent colour image on the display screen.

The display chamber may be formed from any suitable material provided that its volume may be varied by the actuator means. Most preferably at least one wall of the display chamber may comprise a thin flexible membrane or like material where the actuator means takes the form of a piezoelectric crystal. A voltage applied across the crystal will cause the crystal to expand, exerting a force on the flexible wall of the display chamber.

Examples of suitable valve means include a spool valve, a butterfly valve or a piezoelectric valve. Piezoelectric valves are preferable because of their suitability for the small scales involved in current electronic devices. In such a case, a small voltage across the piezoelectric valve will cause it to flex to an open position to allow fluid communication between the display chamber and the storage chamber.

Another form of valve means is where a biasing means is provided to keep the valve body in the closed position. When the actuator means exerts pressure on the flexible wall, there is a build up of pressure inside the display chamber. This forces the valve means to an open position. When the actuator means is deactivated, no pressure is exerted on the valve body and so the biasing means returns the valve body to its closed position. Such a valve can also operate in the same manner to allow flow from the storage chamber to the display chamber.

The screen display device may be controlled by any suitable electronic control device. There may be one control means for each screen display device. Alternatively, the control device can be responsible for any number of screen display devices.

Figure 3:
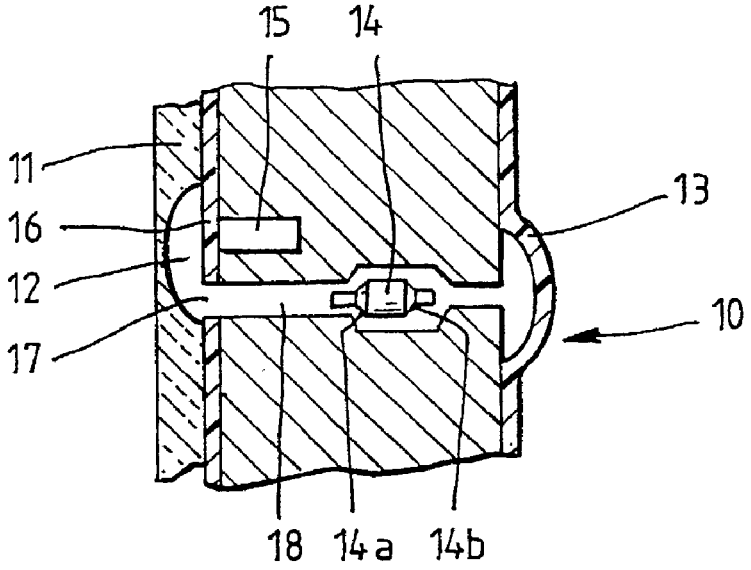
FIG. 3 is a partial cross-sectional view of another section of a screen display device according to one embodiment of the invention.

Referring to FIG. 3, there is provided another form of a screen display element according to the invention. Screen display element 10 comprises a display screen 11, display chamber 12, storage chamber 13, valve means 14 with forward and rear valve seats 14*a* and 14*b* and actuator means 15. Display chamber 12 is formed as part of display surface 11 with a rear wall 16 made from a thin flexible elastic material. Wall 16 has an aperture 17 connected to storage chamber 13 via passage 18. Valve means 14 is a spool valve located within passage 18. Actuator means 15 is a transducer and is located adjacent to wall 16. Storage chamber 13 also includes a thin flexible elastic material as wall 16.

Figure 1:
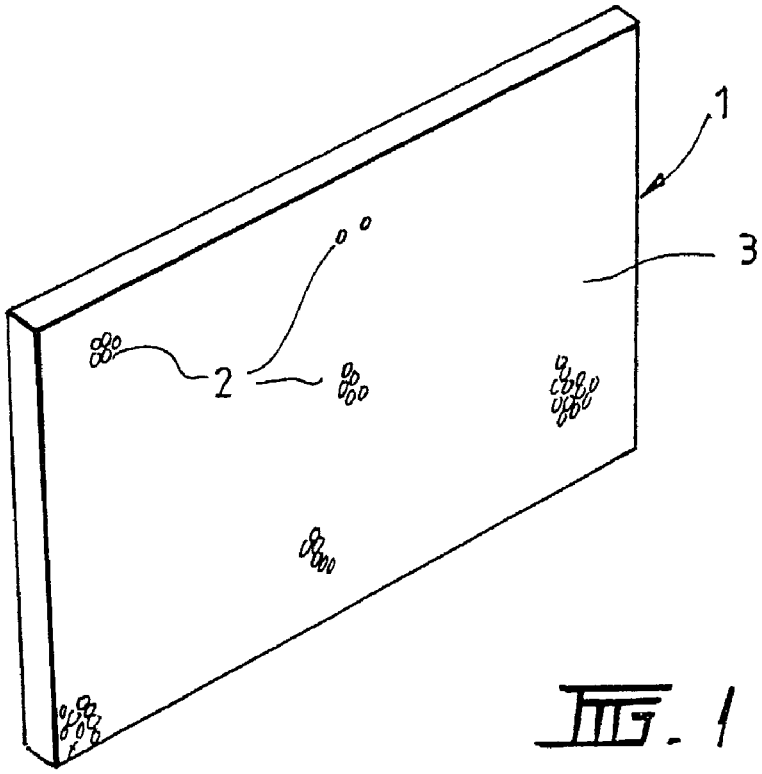
FIG. 1 is an isometric view of a screen display device according to one embodiment of the invention.

In this arrangement, the screen display element works much in the same way as in FIG. 1. When actuator means 15 exerts pressure on wall 16, wall 16 flexes towards display surface 11. This forces liquid into passage 18 via aperture 17 and valve means 14 (which is in its open position) into storage chamber 13 which flexes outwardly to contain the liquid. When valve means 14 is placed in its open position, liquid is forced back into display chamber 12 due to the storage chamber 13 flexing back to its original position.

Figure 4:
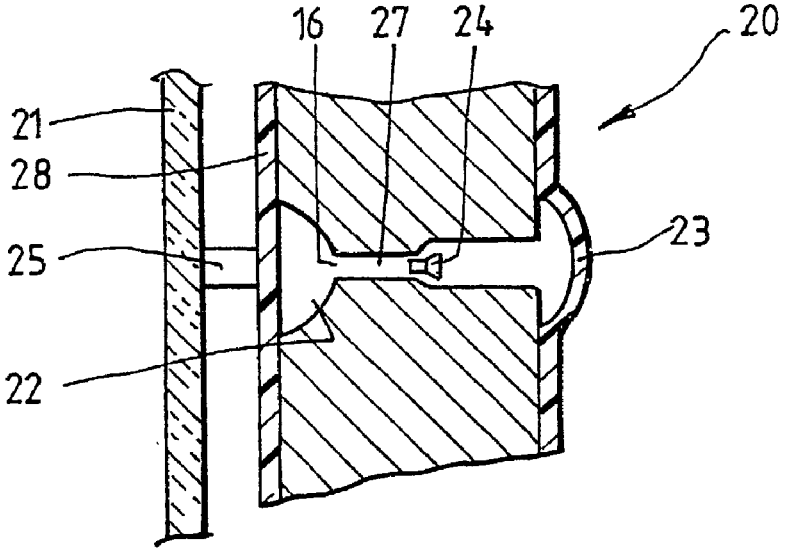
FIG. 4 is a cross-sectional view of another section of a screen display device according to one embodiment of the invention.

Referring to FIG. 4 of the drawings, there is disclosed yet another preferred form of a screen display element for a screen display device according to the invention. A screen display element for the screen display device comprises a display surface 21, display chamber 22, storage chamber 23, valve means 24 and actuator means 25. Display chamber 22 is in fluid communication with storage chamber 23 via aperture 26 and passage 27. Valve means 24 is located within passage 27. Display chamber 22 is formed from a portion of the screen saving device 21 and wall 28 made from thin flexible elastic material. Actuator means 25 is a transparent transducer and is located between display surface 21 and wall 28. Storage chamber 23 is made from the same thin flexible elastic material as wall 28.

This preferred embodiment works in a manner similar to that as described for FIG. 2, but in this case, actuator means 25 is between display surface 22 and wall 28. Consequently, in operation actuator means 25 exerts pressure against wall 28 and squeezes the liquid from display chamber 22 through aperture 26 into passage 27. The liquid passes valve means 24 (in its open position) and enters storage chamber 23, which expands to contain the liquid.

The word 'comprising' and forms of the word 'comprising' as used in this description and in the claims does not limit the invention claimed to exclude any variants or additions.

Modifications and improvements to the invention will be readily apparent to those skilled in the art. Such modifications and improvements are intended to be within the scope of this invention.

The invention claimed is:

1. A screen display device with a plurality of display elements, the display elements comprising:

(a) at least one display chamber for containing display fluid;

(b) at least one storage chamber in fluid communication with the display chamber;

(c) the fluid capable of being moved between the display chamber and the storm chamber; and (d) control means for controlling fluid movement between the display chamber and the storage chamber; and (e) a display screen;

wherein each display chamber is arranged to provide an image of fluid in the display chamber through the display screen;

wherein the movement of fluid between the display chamber and the storage chamber is facilitated by a movement means;

wherein the display chamber is constructed so as to have a variable volume;

wherein the display chamber volume is varied by the movement means;

wherein the movement means is made from a substantially transparent material and arranged between the display screen and the display chamber.

2. The screen display device of claim 1 wherein the display chamber abuts the display screen.

3. The screen display device of claim 1 wherein the display screen forms a wall of the display chamber.

4. The screen display device of claim 1 wherein the wall of the display chamber through which the fluid is viewed is at least substantially translucent.

5. The screen display device of claim 1 wherein the wall of the display chamber through which the fluid is viewed is substantially transparent.

6. The screen display device of claim 1 wherein the display chamber variable volume is provided by at least one substantially flexible movable or elastic wall.

7. The screen display device of claim 1 wherein the movement means comprises a piston.

8. The screen display device of claim 1 wherein the movement means comprises a piezoelectic crystal specifically adapted to expand and press against a wall of the display chamber.

9. The screen display device of claim 1 wherein the movement means comprises an electromagnetic transducer.

10. The screen display device of claim 1 wherein the storage chamber comprises means to prevent fluid held in the storage chamber from forming an image on the display screen.

11. The screen display device of claim 1 wherein the storage chamber comprises a return means for returning fluid to the display chamber.

12. The screen display device of claim 1 wherein the control means comprises a valve means such as a piezoelectric valve.

13. The screen display device of claim 1 wherein each of the display elements is substantially sealed against fluid communication with all of the other display elements.

14. The screen display device of claim 1 wherein a plurality of display elements are grouped together to form a pixel.

15. The screen display device of claim 14 wherein different members of the group of display elements include different colored fluid.

16. The screen display device of claim 15 wherein the display elements form pixels of a generally round or square shape.

17. The screen display device of claim 1 further comprising lighting means provided to light the image on the display screen produced by fluid in the display chamber.

18. The screen display device of claim 17 wherein the light produced by the lighting means impinge forwardly or rearwardly of the display chamber.

19. The screen display device of claim 1 wherein a plurality of storage chambers are in fluid communication with a display chamber.

20. The screen display device of claim 19 wherein each of the storage chambers contains a different colored fluid.

21. An electronic device having a screen display device according to claim 1.

22. An electronic device according to claim 21, wherein said electronic device is selected from a monitor, a computer, a laptop computer, a hand held computer, an electronic organizer, a telephone or mobile telephone or a television monitor.

23. A screen display device with a plurality of display elements, the display elements comprising:

(a) at least one display chamber for containing display fluid;

(b) at least one storage chamber in fluid communication with the display chamber;

(c) the fluid capable of being moved between the display chamber and the storage chamber; and (d) control means for controlling fluid movement between the display chamber and the storage chamber; and (e) a display screen:

wherein each display chamber is arranged to provide an image of fluid in the display chamber through the display screen: and wherein the storage chamber is formed of substantially non transparent material.

24. A screen display device with a plurality of display elements, the display elements comprising:

(a) at least one display chamber for containing display fluid;

(b) at least one storage chamber in fluid communication with the display chamber;

(c) the fluid capable of being moved between the display chamber and the storage chamber; and (d) control means for controlling fluid movement between the display chamber and the storage chamber; and (e) a display screen:

wherein each display chamber is arranged to provide an image of fluid in the display chamber through the display screen; and wherein the storage chamber is coated or shielded with non-transparent material.

25. A screen display device with a plurality of display elements, the display elements comprising:

(a) at least one display chamber for containing display fluid;

(b) at least one storage chamber in fluid communication with the display chamber;

(c) the fluid capable of being moved between the display chamber and the storage chamber; and (d) control means for controlling fluid movement between the display chamber and the storage chamber; and (e) a display screen;

wherein each display chamber is arranged to provide an image of fluid in the display chamber through the display screen; and wherein the storage chamber is constructed so as to have a variable volume.

26. The screen display device of claim 25 wherein the display chamber volume is varied by the movement means.

27. The screen display device of claim 26 wherein the movement means comprises an actuator means such as a piston.

28. The screen display device of claim 26 wherein the movement means comprises a piezoelectric crystal specifically adapted to expand and press against a wall of the display chamber.

29. The screen display device of claim 26 wherein the movement means comprises an electromagnetic transducer.

30. The screen display device of claim 25 wherein the storage chamber variable volume is provided by at least one substantially flexible, movable or elastic wall.

31. A screen display device with a plurality of display elements, the display elements comprising:

(a) at least one display chamber for containing display fluid;

(b) at least one storage chamber in fluid communication with the display chamber;

(c) the fluid capable of being moved between the display chamber and the storage chamber; and (d) control means for controlling fluid movement between the display chamber and the storage chamber; and (e) a display screen;

wherein each display chamber is arranged to provide an image of fluid in the display chamber through the display screen;

wherein at least one conduit is located between the display chamber and storage chamber; and wherein the control means is locatable in the conduit.

32. The screen display device of claim 31 wherein the conduit is integrally formed with the display chamber and storage chamber.

33. A screen display device with plurality of display elements, the display elements comprising:

(a) at least one display chamber for containing display fluid;

(b) at least one storage chamber in fluid communication with the display chamber;

(c) the fluid capable of being moved between the display chamber and storage chamber; and (d) control means for controlling fluid movement between the display chamber and the storage chamber; and (e) a display screen;

wherein each display chamber is arranged to provide an image of fluid in the display chamber through the display screen; and wherein the control means comprises a biasing means, a valve body and at least one valve seat.

34. A screen display device with a plurality of display elements, the display elements comprising:

(a) at least one display chamber for containing display fluid;

(b) at least one storage chamber in fluid communication with the display chamber;

(c) the fluid capable of being moved between the display chamber and the storage chamber; and (d) control means for controlling fluid movement between the display chamber and the storage chamber; and (e) a display screen;

wherein each display chamber is arranged to provide an image of fluid in the display chamber through the display screen;and wherein the control means is selected from a group comprising spool valves and butterfly valves.

35. A screen display device with a plurality of display elements, the display elements comprising a membrane defining a storage chamber and a display chamber for containing display fluid; and a display screen, the fluid capable of being moved between the display chamber and the storage chamber; wherein each display chamber is arranged to provide an image of fluid in the display chamber Through the display screen; wherein the movement of the fluid is facilitated by movement of the membrane; and wherein the movement of the membrane is from a position abutting the display screen to a position remote of the display screen.

36. The screen display device of claim 35 wherein the movement of the membrane is by membrane movement means.

* * * * *